US009472902B2

(12) United States Patent
Kao et al.

(10) Patent No.: US 9,472,902 B2
(45) Date of Patent: Oct. 18, 2016

(54) ELECTRICAL RECEPTACLE CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Wen-Hsien Tsai, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/799,036

(22) Filed: Jul. 14, 2015

(65) Prior Publication Data

US 2016/0013592 A1 Jan. 14, 2016

(30) Foreign Application Priority Data

Jul. 14, 2014 (TW) ..... 103124185 A
Nov. 28, 2014 (TW) ..... 103141532 A

(51) Int. Cl.

| | |
|---|---|
| ***H01R 13/648*** | (2006.01) |
| ***H01R 13/6581*** | (2011.01) |
| ***H01R 13/6471*** | (2011.01) |
| *H01R 24/60* | (2011.01) |
| *H01R 12/72* | (2011.01) |
| *H01R 13/6594* | (2011.01) |

(52) U.S. Cl.

CPC ..... *H01R 13/6581* (2013.01); *H01R 13/6471* (2013.01); *H01R 12/724* (2013.01); *H01R 13/6594* (2013.01); *H01R 24/60* (2013.01)

(58) Field of Classification Search

CPC ..... H01R 13/6587; H01R 13/6594; H01R 23/6873
USPC ..... 439/607.4, 939, 108
See application file for complete search history.

(56) References Cited

U.S. PATENT DOCUMENTS

| | | | | |
|---|---|---|---|---|
| 6,350,134 | B1 * | 2/2002 | Fogg | H05K 1/0219 439/79 |
| 6,935,870 | B2 * | 8/2005 | Kato | H01R 13/65807 439/108 |
| 7,435,110 | B2 * | 10/2008 | Xiao | H01R 12/58 439/107 |
| 7,448,884 | B2 * | 11/2008 | Kato | H01R 23/6873 439/108 |
| 7,674,118 | B2 * | 3/2010 | He | H01R 24/60 439/108 |
| 8,864,501 | B2 * | 10/2014 | Lin | H01R 13/65807 439/607.4 |

* cited by examiner

*Primary Examiner* — Phuong Dinh
(74) *Attorney, Agent, or Firm* — Muncy, Geissler, Olds & Lowe, P.C.

(57) ABSTRACT

An electrical receptacle connector includes a metallic shell, an insulated housing, a plurality of upper-row receptacle terminals, and a plurality of lower-row receptacle terminals. The insulated housing is received in the metallic shell. The upper-row receptacle terminals are held in the insulated housing and include a plurality of tail portions protruded from a bottom of the insulation body to be arranged into a row. The lower-row receptacle terminals are held in the insulated housing and include a plurality of tail portions protruded from the bottom of the insulated housing to be arranged into a first row and a second row. The tail portions of the lower-row receptacle terminals are parallel to the tail portions of the upper-row receptacle terminals.

17 Claims, 14 Drawing Sheets

ELECTRICAL RECEPTACLE CONNECTOR

CROSS-REFERENCES TO RELATED APPLICATIONS

This non-provisional application claims priority under 35 U.S.C. §119(a) on Patent Application No. 103124185 and 103141532, filed in Taiwan, R.O.C. on 2014 Jul. 14 and 2014 Nov. 28, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use, from the end user's point of view. Now, as technology innovation marches forward, new kinds of devices, media formats and large inexpensive storage products are converging. They require significantly more bus bandwidth to maintain the interactive experience that users have come to expect. In addition, user applications demand a higher performance between the PC and sophisticated peripherals. The transmission rate of USB 2.0 is insufficient. Consequently, faster serial bus interfaces, such as USB 3.0, have been developed to address the need by adding a higher transmission rate to match usage patterns and devices.

Existing USB electrical receptacle connectors meet the requirements of transmitting USB 3.0 signals. During transmission, unwanted interference must be effectively eliminated by conduction and grounding. An existing USB 3.0 compatible electrical receptacle connector includes an insulated housing, a plurality of terminals, and a metallic shell. The terminals are disposed on the insulated housing, and the insulated housing is received in the metallic shell. The conduction and grounding of a circuit in the existing electrical receptacle connector are achieved through connection with the terminals and the grounding sheet.

When the existing USB 3.0 connector is adapted to transmit USB 2.0 signals, high-speed terminals (i.e., terminals for transmitting USB 3.0 signals) of the connector are not required. However, due to the rigid architecture of the connector, it is hard to make connectors for transmitting USB 2.0 signals by simply removing the high-speed terminals from the USB 3.0 connectors. Therefore, in order to make connectors for transmitting USB 2.0 signals, additional manufacturing cost and manufacturing time for the USB 2.0 connectors cannot be reduced.

SUMMARY OF THE INVENTION

It is therefore necessary to establish and develop a new architecture of USB connectors to address the previously mentioned needs of platforms and devices, while retaining all of the functional benefits of USB that form the basis for this most popular of computing device interconnects.

In view of this, the instant disclosure provides an electrical receptacle connector. An embodiment of the electrical receptacle connector comprises a metallic shell, an insulated housing, a plurality of upper-row receptacle terminals and a plurality of lower-row receptacle terminals. The metallic shell comprises a top cover plate, a rear cover plate, and defines a receptacle cavity. The rear cover plate is extended from a back side of the top cover plate and extended backward to cover a back side of the receptacle cavity. A plurality of pins is extended from two sides of a bottom of the rear cover plate. The insulated housing is received in the receptacle cavity and comprises a base portion and a tongue portion. The tongue portion is extended from one of two sides of the base portion in the front-to-rear direction and has an upper surface and a lower surface. The upper-row receptacle terminals comprise a plurality of signal terminals, at least one power terminal, and at least one ground terminal. Each of the upper-row receptacle terminals is held in the base portion and the tongue portion and disposed at the upper surface. Each of the upper-row receptacle terminals comprises a tail portion protruded from a bottom of the base portion to be arranged into a row. The tail portions of the upper-row receptacle terminals are near to the pins. The lower-row receptacle terminals comprise a plurality of signal terminals, at least one power terminal, and at least one ground terminal. Each of the lower-row receptacle terminals is held in the base portion and the tongue portion and disposed at the lower surface. Each of the lower-row receptacle terminals comprises a tail portion protruded from the bottom of the base portion to be arranged into a first row and a second row. The tail portions of the lower-row receptacle terminals are parallel to the tail portions of the upper-row receptacle terminals.

In conclusion, when the contacts between the tail portions of the lower-row receptacle terminals (namely, the contacts of the grounding sheet), are omitted, the electrical receptacle connector can transmit USB 2.0 signals without changing or rearranging the configuration of the lower-row receptacle terminals. Therefore, when the electrical receptacle connector is provided for transmitting USB 2.0 signals, manufacturing steps for the grounding sheet and the contacts of the grounding sheet can be omitted so as to simplify the manufacturing process of the electrical receptacle connector and reduce the manufacturing cost of the electrical receptacle connector. Conversely, when the electrical receptacle connector is provided for transmitting USB 3.0 signals, the grounding sheet and the contacts of the grounding sheet are assembled to the electrical receptacle connector, so that effective noise grounding and conduction can be accomplished by the contacts of the grounding sheet connected to the circuit board. Furthermore, when the rear cover plate comprises the through-hole legs to be soldered with the circuit board, the grounding resistance and the electromagnetic interference can be reduced.

Furthermore, pin-assignments of the upper-row receptacle terminals and the lower-row receptacle terminals are 180 degree symmetrical, dual or double orientation design which enable an electrical plug connector to be inserted into the electrical receptacle connector in either of two intuitive orientations, i.e., in either upside-up or upside-down directions. In other words, the pin-assignments of the upper-row receptacle terminals and the lower-row receptacle terminals have 180 degree symmetrical, dual or double orientation design with respect to a central point of the receptacle cavity as the symmetrical center. Consequently, an electrical plug connector is inserted into the electrical receptacle connector with a first orientation where the upper surface of the tongue portion is facing up, for transmitting first signals. Conversely, the electrical plug connector is inserted into the electrical receptacle connector with a second orientation where the upper surface of the tongue portion is facing down, for transmitting second signals. Furthermore, the specification for transmitting the first signals is conformed to the specification for transmitting the second signals.

Detailed description of the characteristics and the advantages of the instant disclosure is shown in the following embodiments, the technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
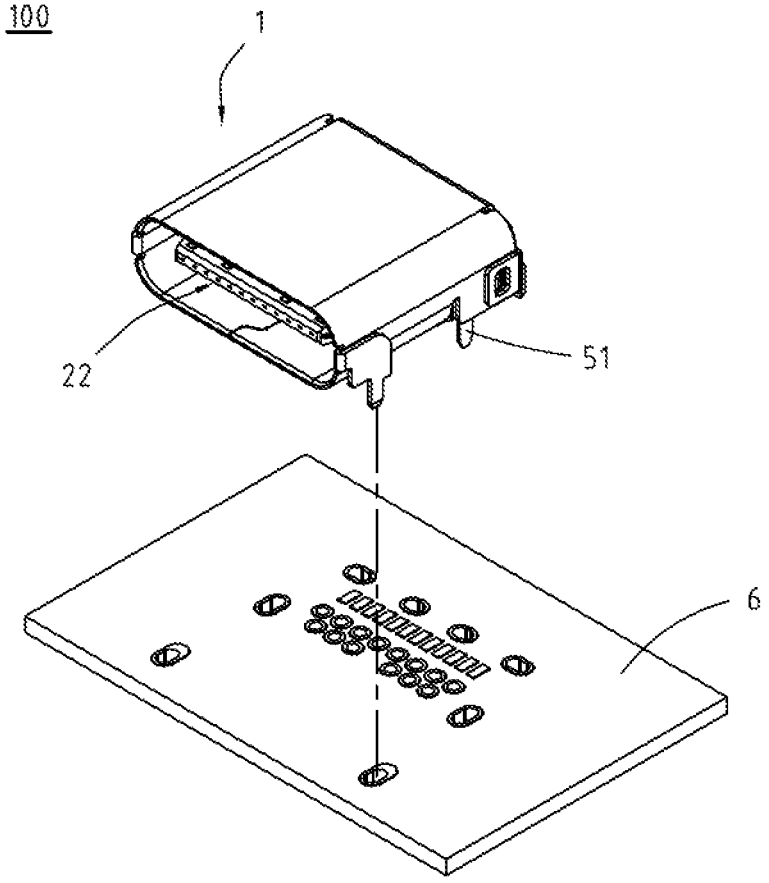
FIG. 1 is an exploded perspective view showing an electrical receptacle connector assembled with a circuit board according to a first embodiment of the instant disclosure.
Figure 2:
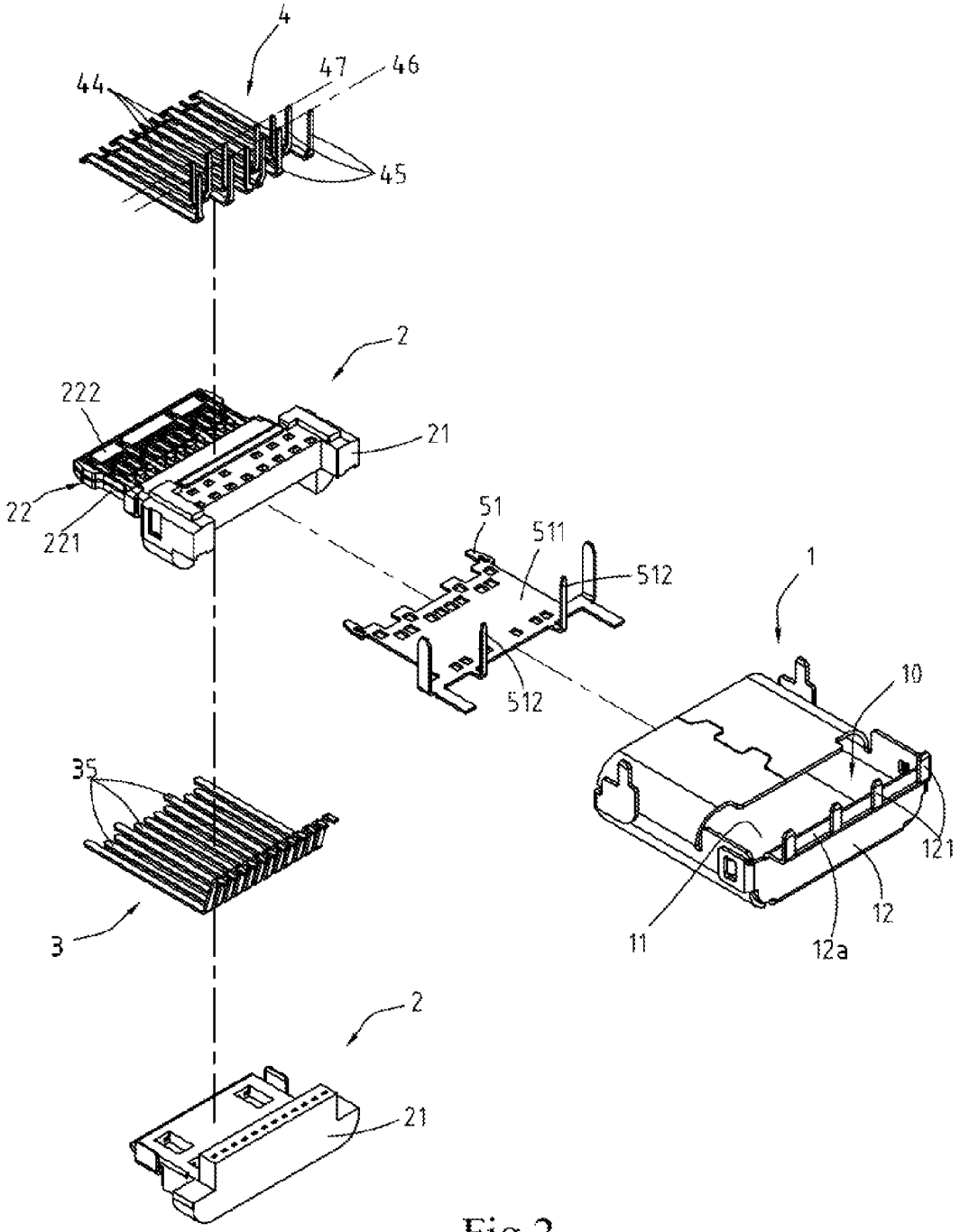
FIG. 2 is an exploded perspective view of the electrical receptacle connector of the first embodiment, where a metallic shell of the electrical receptacle connector is arranged upside down.
Figure 3:
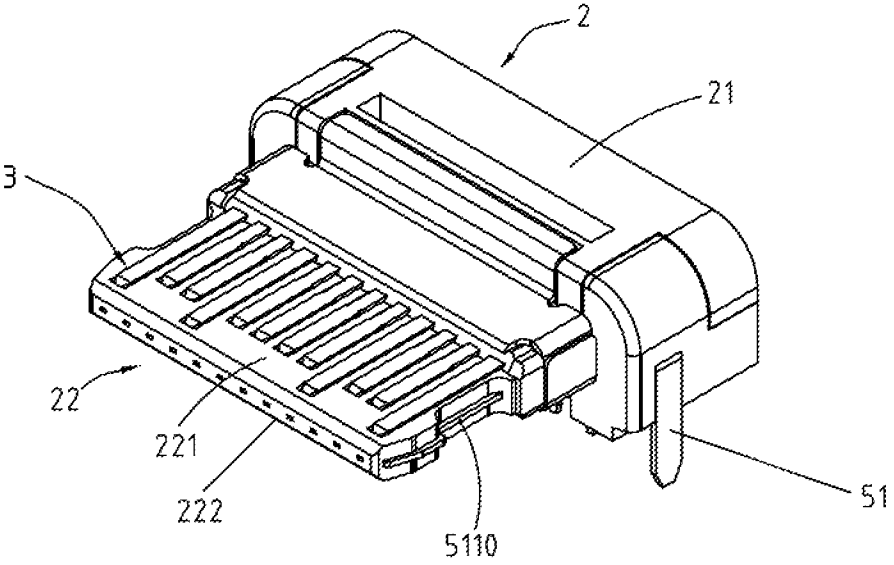
FIG. 3 is a perspective view (1) of the electrical receptacle connector of the first embodiment, where the metallic shell is not shown.
Figure 4:
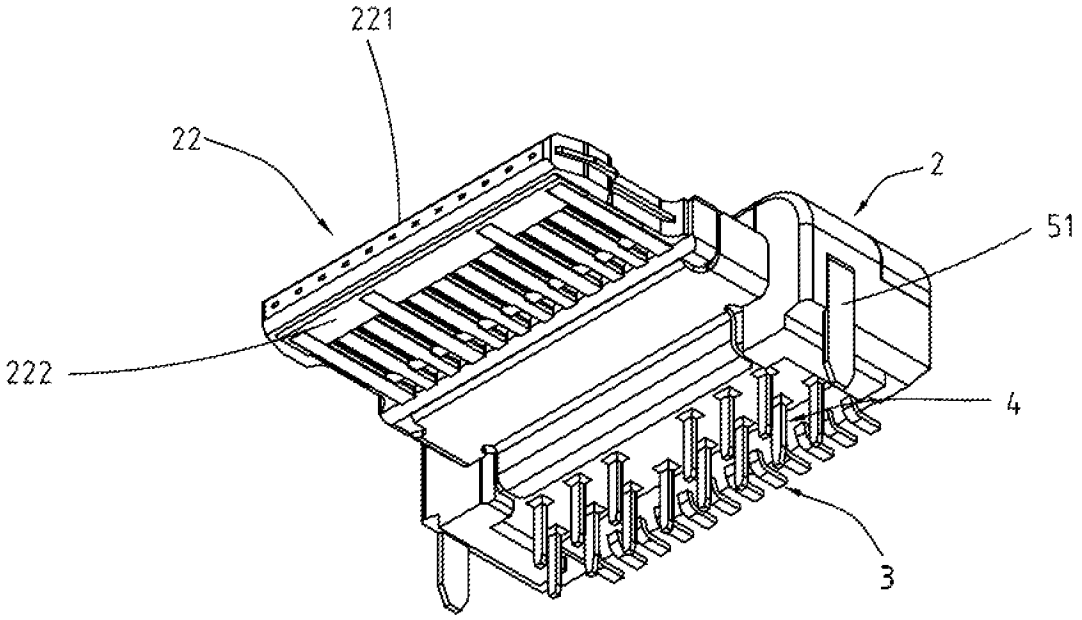
FIG. 4 is a perspective view (2) of the electrical receptacle connector according to the first embodiment, where the metallic shell is not shown.
Figure 5:
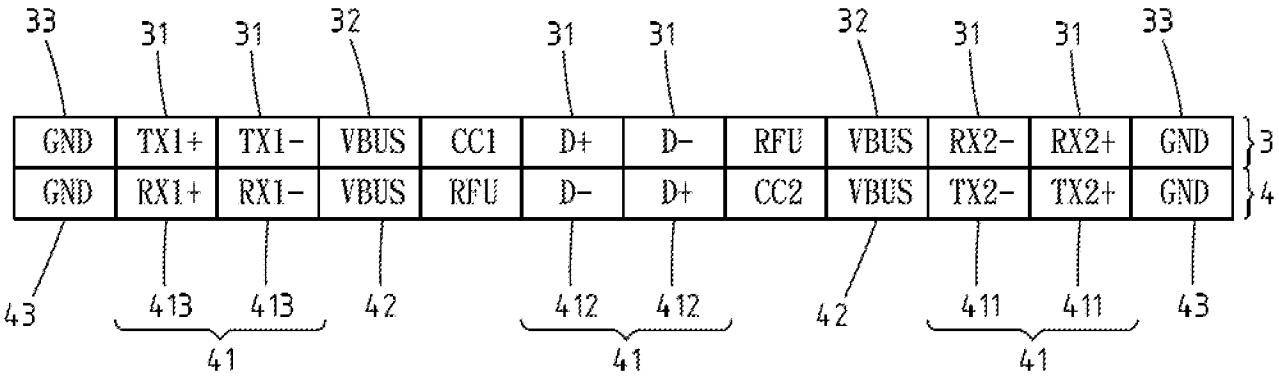
FIG. 5 is a schematic configuration diagram of receptacle terminals of the electrical receptacle connector of the first embodiment.

Please refer to FIG. 1 to FIG. 5, illustrating a first embodiment of an electrical receptacle connector 100. FIG. 1 is an exploded perspective view showing an electrical receptacle connector 100 assembled with a circuit board 6 according to a first embodiment of the instant disclosure. FIG. 2 is an exploded perspective view of the electrical receptacle connector 100 of the first embodiment, where a metallic shell 1 of the electrical receptacle connector 100 is arranged upside down. FIG. 3 is a perspective view (1) of the electrical receptacle connector 100 of the first embodiment, where the metallic shell 1 is not shown. FIG. 4 is a perspective view (2) of the electrical receptacle connector 100 of the first embodiment, where the metallic shell 1 is not shown. FIG. 5 is a schematic configuration diagram of receptacle terminals 3, 4 (that is, upper-row receptacle terminals 3 and lower-row receptacle terminals 4) of the electrical receptacle connector 100 of the first embodiment. The electrical receptacle connector 100 described herein provides a USB Type-C connection interface. The electrical receptacle connector 100 comprises a metallic shell 1, an insulated housing 2, a plurality of upper-row receptacle terminals 3, and a plurality of lower-row receptacle terminals 4. The electrical receptacle connector 100 is combinable on a circuit board 6.

Figure 6:
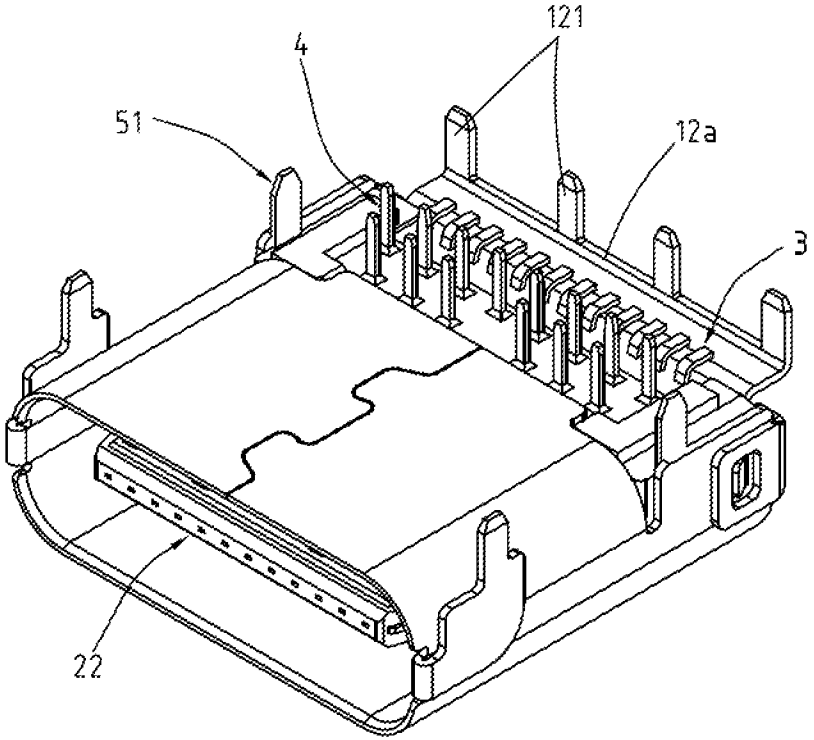
FIG. 6 is a back perspective view of the electrical receptacle connector of the first embodiment.

FIG. 6 is a back perspective view of the electrical receptacle connector 100 of the first embodiment. Please refer to FIG. 2 and FIG. 6, in which the metallic shell 1 is a hollowed shell and defines a receptacle cavity 10 therein. The insulated housing 2 is received in the metallic shell 1. In this embodiment, the metallic shell 1 comprises a top cover plate 11, a rear cover plate 12, and a plurality of pins 121. The top cover plate 11 is at a top plane of the insulated housing 2, and the rear cover plate 12 is extended from a back side of the top cover plate 11 and extended downward to the back of the insulated housing 2, as shown in FIG. 1. That is, the rear cover plate 12 covers a back side of the receptacle cavity 10. Additionally, the rear cover plate 12 comprises a bottom plane 12*a*, and the pins 121 are through-hole legs and extended downward from the bottom plane 12*a*. That is, the pins are extended from the metallic shell to form vertical legs, named through-hole legs which can be soldered on the surface of a circuit board by through-hole technology. Alternatively, in some implementation aspects, the pins 121 are SMT (surface mount technology) legs, i.e., the pins 121 are bent horizontally to form flat legs, named SMT legs which can be soldered or mounted on the surface of a circuit board by using surface mount technology.

Please refer to FIG. 2, FIG. 3 and FIG. 4, in which the insulated housing 2 comprises a base portion 21 and a tongue portion 22. Injection molding techniques are applied to form the base portion 21 and the tongue portion 22. Furthermore, the insulated housing 2 can be formed by a unitary member or by a multi-piece member. Additionally, the tongue portion 22 is extended from one of two sides of the base portion 21 in the front-to-rear direction, and the tongue portion 22 has an upper surface 221 and a lower surface 222, and the upper surface 221 is opposite to the lower surface 222. Here, the base portion 21 is assumed to be at the front part of the insulated housing 2, and the tongue portion 22 is assumed to be at the rear part of the insulated housing 2.

Please refer to FIG. 2, FIG. 3 and FIG. 4, in which the upper-row receptacle terminals 3 are held at the base portion 21 and the tongue portion 22. Each of the upper-row receptacle terminals 3 comprises a flat contact portion 351, a body portion 353, and a tail portion 352. The body portions 353 are held in the insulated housing 2. Each of the flat contact portions 351 is extended from one of two ends of the corresponding body portion 353 and disposed at the upper surface 221 of the tongue portion 22, and each of the tail portions 352 is extended from the other end of the corresponding body portion 353 to be exposed out of the base portion 21. Furthermore, the tail portions 352 are extended out of the base portion 21. Here, the tail portions 352 are extended out of a bottom of the base portion 21. In addition, the tail portions 352 are arranged in a row and near to the pins 121. In this embodiment, the tail portions 352 are bent horizontally and provided as SMT legs. In some implementation aspects, the tail portions 352 are through-hole legs.

Figure 7:
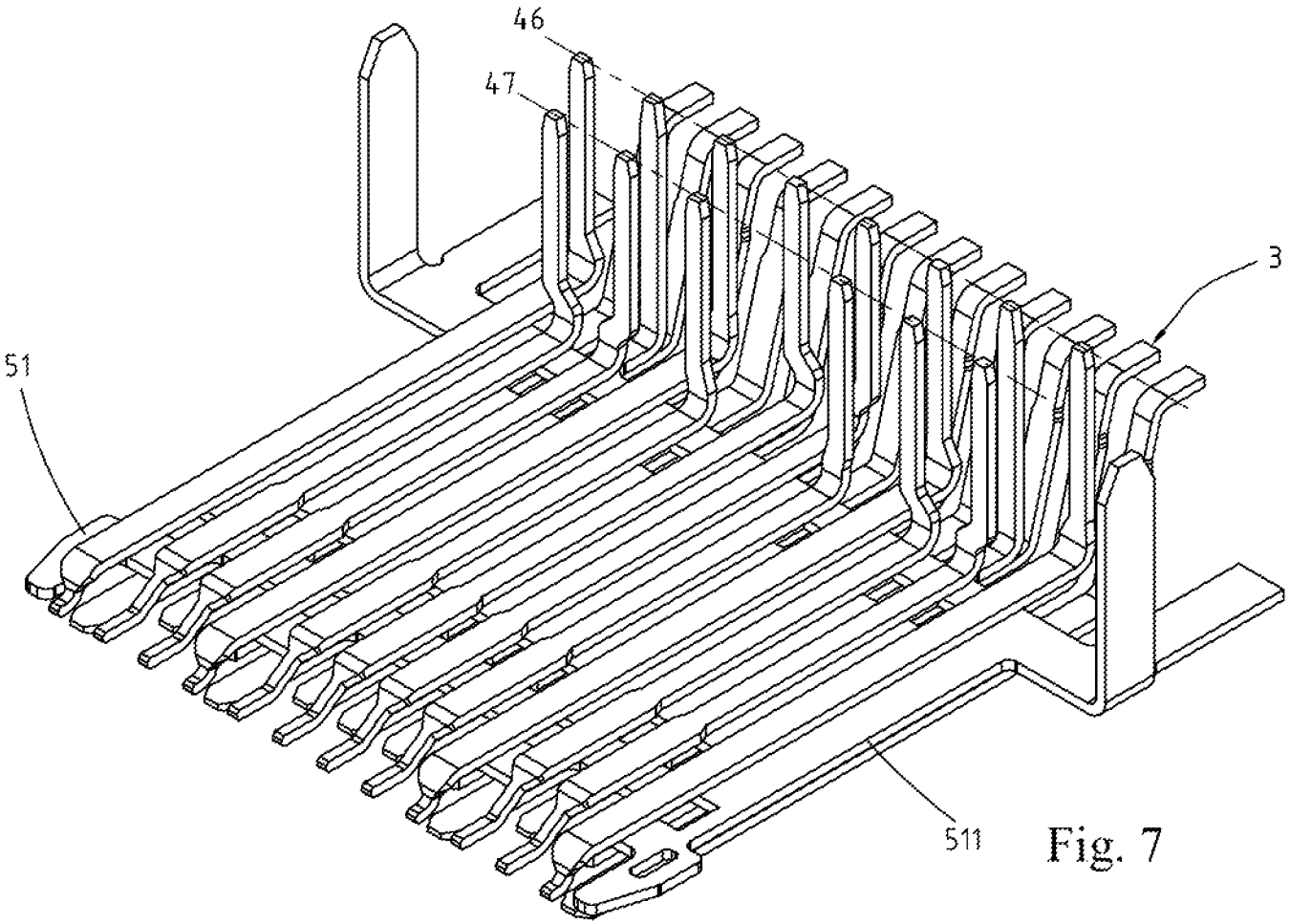
FIG. 7 is a perspective schematic view showing the configuration of the receptacle terminals and a grounding sheet of the electrical receptacle connector of the first embodiment.

FIG. 7 is a perspective schematic view showing the configuration of the receptacle terminals 3, 4 and the grounding sheet 51 of the electrical receptacle connector 100 of the first embodiment. Please refer to FIGS. 2, 3, 4, 7, in which the lower-row receptacle terminals 4 are held at the base portion 21 and the tongue plate 22. Each of the lower-row receptacle terminals 4 comprises a flat contact portion 441, a body portion 443, and a tail portion 442. The body portions 443 are held in the insulated housing 2. Each of the flat contact portions 441 is extended from one of two ends of the corresponding body portion 443 and disposed at the lower surface 222 of the tongue portion 22, and each of the tail portions 442 is extended from the other end of the corresponding body portion 443 to be exposed out of the base portion 21. Furthermore, the tail portions 442 are extended out of the base portion 21. Here, the tail portions 442 are extended out of the bottom of the base portion 21. In addition, the tail portions 442 are arranged in a first row 46 and a second row 47. The tail portions 442 are parallel to the tail portions 352 (i.e., the row of the tail portions 352 is parallel to the first row and the second row of the tail portions 442). The tail portions 442 are extended downward to form through-hole legs.

In this embodiment, the tail portions 352, 442 are extended out of the base portion 21 and arranged separately. For example, the tail portions 352, 442 may form three rows, and the tail portions 442 of the lower-row receptacle terminals 4 are aligned parallel to the tail portions 352 of the upper-row receptacle terminals 3. Here, the first row 46 of the tail portions 442 are disposed between the row of the tail portions 352 and the second row 47 of the tail portions 442, but embodiments are not limited thereto. Furthermore, the overall width of first row 46 of the tail portions 442 is greater than the overall width of the second row 47 of the tail portions 442.

The upper-row receptacle terminals 3 comprises a plurality of signal terminals 31, at least one power terminal 32, and at least one ground terminal 33. Please refer to FIGS. 3, 4, 5, and 5A, in which the upper-row receptacle terminals 3 comprises a plurality of signal terminals 31, a plurality of power terminals 32, and a plurality of ground terminals 33. The signal terminals 31 are at the upper surface 221 and transmitting first signals (that is, USB 3.0 signals). As shown in FIG. 5, the upper-row receptacle terminals 3 comprise, from left to right, a ground terminal 33 (Gnd), a first pair of differential signal terminals (TX1+−), a second pair of differential signal terminals (D+−), and a third pair of differential signal terminals (RX2+−), of the signal terminals 31, power terminals 32 (Power/VBUS), between the three pairs of differential signal terminals, a retain terminal (RFU) (the retain terminal and a configuration channel 1 (CC1) are respectively arranged between the power terminals 32 and the second pair of differential signal terminals), and another ground terminal 33 (Gnd). However, the pin assignments are not thus limited, and the example described above is only for illustrative purposes. In this embodiment, twelve upper-row receptacle terminals 3 are provided to meet the transmission of USB 3.0 signals, but embodiments are not limited thereto. In some implementation aspects, the far right ground terminal 33 (or the far left ground terminal 33) and the retain terminal are omitted. Furthermore, the far right ground terminal 33 can be replaced by a power terminal 32 and provided for power transmission.

The lower-row receptacle terminals 4 comprises a plurality of signal terminals 41, at least one power terminal 42, and at least one ground terminal 43. Please refer to FIGS. 3, 4, 5, and 5A, in which the lower-row receptacle terminals 4 comprises a plurality of signal terminals 41, a plurality of power terminals 42, and a plurality of ground terminals 43. The signal terminals 41 are at the lower surface 222 and transmitting second signals (that is, USB 3.0 signals). As shown in FIG. 5, the lower-row receptacle terminals 4 comprise, from right to left, a ground terminal 43 (Gnd), a first pair of differential signal terminals (TX2+−), a second pair of differential signal terminals (D+−), and a third pair of differential signal terminals (RX1+−), of the signal terminals 41, power terminals 42 (Power/VBUS), between the three pairs of differential signal terminals, a retain terminal (RFU) (the retain terminal and a configuration channel 2 (CC2) are a respectively arranged between the power terminals 42 and the second pair of differential signal terminals), and another ground terminal 43. However, the pin assignments are not thus limited, and the example described above is only for illustrative purposes. In this embodiment, twelve lower-row receptacle terminals 4 are provided to meet the transmission of USB 3.0 signals, but embodiments are not limited thereto. In some implementation aspects, the far right ground terminal 43 (or the far left ground terminal 43) and the retain terminal are omitted. Furthermore, the far right ground terminal 43 can be replaced by a power terminal 42 and provided for power transmission.

Please refer to FIG. 3, FIG. 4 and FIG. 5, in which embodiment the upper-row receptacle terminals 3 and the lower-row receptacle terminals 4 meet the transmission of USB 3.0 signals, but embodiments are not limited thereto. In some implementation aspects, for the upper-row receptacle terminals 3 in accordance with transmission of USB 2.0 signals, the first and third pairs of differential signal terminals are omitted, and the second pair of differential signal terminals and the power terminals 32 are retained for transmitting USB 2.0 signals. While, for the lower-row receptacle terminals 4 in accordance with transmission of USB 2.0 signals, the first and third pairs of differential signal terminals are omitted, and the second pair of differential signal terminals and the power terminals 42 are retained for transmitting USB 2.0 signals.

Please refer to FIGS. 3, 4, 5, and 5A, in which embodiment the upper-row receptacle terminals 3 and the lower-row receptacle terminals 4 are respectively at the upper surface 221 and the lower surface 222 of the tongue portion 22. Furthermore, the upper-row receptacle terminals 3 and the lower-row receptacle terminals 4 are point-symmetrical with a central point of the receptacle cavity 10 as the symmetrical center. In other words, pin-assignments of the upper-row receptacle terminals 3 and the lower-row receptacle terminals 4 have 180 degree symmetrical design with respect to the central point of the receptacle cavity 10 as the symmetrical center. The dual or double orientation design enables an electrical plug connector to be inserted into the electrical receptacle connector 100 in either of two intuitive orientations, i.e., in either upside-up or upside-down directions. Here, point-symmetry means, after the upper-row receptacle terminals 3 (or the lower-row receptacle terminals 4) are rotated by 180 degrees with the symmetrical center as the rotating center, the upper-row receptacle terminals 3 and the lower-row receptacle terminals 4 are overlapped. That is, the rotated upper-row receptacle terminals 3 are arranged at the position of the original lower-row receptacle terminals 4, and the rotated lower-row receptacle terminals 4 are arranged at the position of the original upper-row receptacle terminals 3. In other words, the upper-row receptacle terminals 3 and the lower-row receptacle terminals 4 are arranged upside down, and the pin assignments of the upper-row receptacle terminals 3 are left-right reversal with respect to the pin assignments of the lower-row receptacle terminals 4. Accordingly, an electrical plug connector is inserted into the electrical receptacle connector 100 with a first orientation where the upper surface 221 of the tongue portion 22 is facing upward, for transmitting first signals. Conversely, the electrical plug connector is inserted into the electrical receptacle connector 100 with a second orientation where the upper surface 221 of the tongue portion 22 is facing downward, for transmitting second signals. The specification for transmitting the first signals conforms to that for transmitting the second signals. Based on this, the inserting orientation of the electrical plug connector is not limited by the electrical receptacle connector 100

Figure 5A:
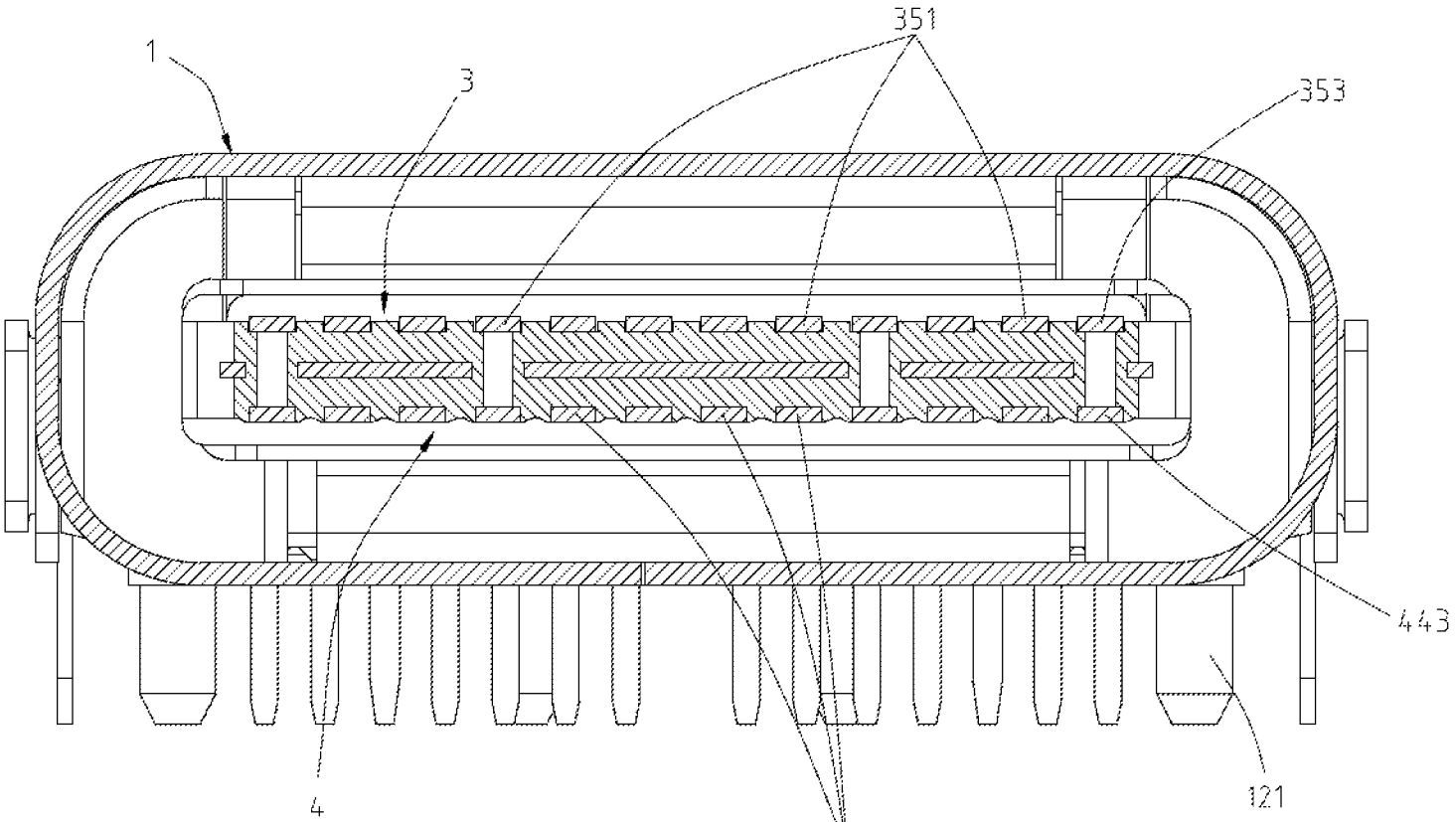
FIG. 5A is a front sectional view of the electrical receptacle connector of the first embodiment.

Please refer to FIG. 5A and FIG. 7, in which embodiment positions of the upper-row receptacle terminals 3 correspond to positions of the lower-row receptacle terminals 4.

Please refer to FIG. 2, FIG. 6 and FIG. 7, in which embodiment the electrical receptacle connector 100 further comprises a grounding sheet 51 at the insulated housing 21. The grounding sheet 51 comprises a main body 511 and a plurality of contacts 512. The main body 511 is between the upper-row receptacle terminals 3 and the lower-row receptacle terminals 4. That is, the main body 511 is formed between the base portion 211 and the tongue portion 212 to be disposed between the flat contact portions 351, 441. The contacts 512 are extended from two sides of the rear part of the main body 11. Furthermore, the contacts 512 are extended from the bottom of the base portion 21 and between the tail portions 442. Here, each of the contacts 512 is respectively disposed in the first row 46 of the tail portion 442. In addition, the contacts 512 are exposed from the base portion 211 and connected to the circuit board 6. When the flat contact portions 351, 441 transmit signals, the crosstalk interferences problems can be improved by separating the flat contact portions 351 of the upper-row receptacle terminals 3 and the flat contact portions 441 of the lower-row receptacle terminals 4 with the grounding sheet 51. Furthermore, the structural strength of the tongue portion 212 can be improved by arranging the grounding sheet 51 at the tongue portion 212. Here, when the upper-row receptacle terminals 3 and the lower-row receptacle terminals 4 are transmitting USB 3.0 signals (that is, the flat contact portions 351, 441 transmit high-speed signals), effective noise grounding and conduction can be accomplished by the connection of the contacts 512 of the grounding sheet 51 and the circuit board 6. Additionally, as shown in FIG. 3, the grounding sheet 51 further comprises two lateral sides 5110 which are protruded out the lateral sides of the insulation housing 21.

Figure 8A:
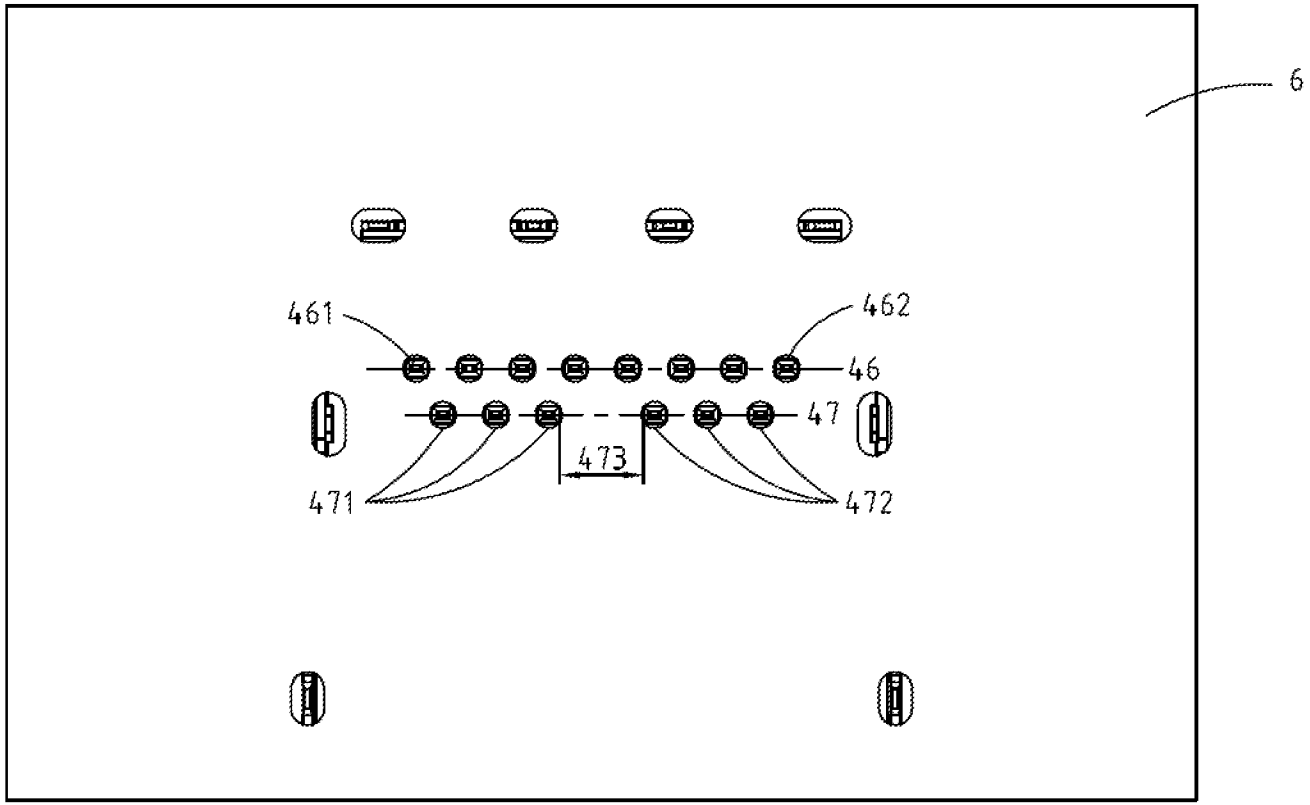
FIG. 8A is a bottom view of the electrical receptacle connector assembled with the circuit board, of the first embodiment, for one implementation aspect.

FIG. 8A is a bottom view of the electrical receptacle connector 100 assembled with the circuit board 6, of the first embodiment, for one implementation aspect. Please refer to FIG. 2, FIG. 6 and FIG. 8A, in which embodiment the rear cover plate 12 of the metallic shell 1 covers the back side of the receptacle cavity 10, so that the exposed area of the metallic shell 1 can be reduced. In this embodiment, four pins 121 of the rear cover plate 12 are distantly arranged at the bottom plane 12*a* and are soldered on the circuit board 6. When transmitting USB 3.0 signals, the flat contact portions 351, 441 transmit signals with high speed, and the electromagnetic waves are efficiently shielded by the rear cover plate 12 and are efficiently conducted and grounded by the pins 121 of the rear cover plate 12 connected to the circuit board 6. Furthermore, the pins 121 of the rear cover plate 12 can be through-hole legs and soldered on the circuit board 6 to reduce the grounding resistance and the electromagnetic interference (EMI).

In addition, according to a result of electromagnetic-wave leak distribution experiments, it can be understood that the electromagnetic waves are efficiently shielded by the rear cover plate 12, and the pins 121 are connected to the circuit board 6 for noise grounded, so that a better retardation of EMI or RFI can be accomplished. Furthermore, the pins 121 of the rear cover plate 12 strengthen the positioning force between the electrical receptacle connector 100 and the circuit board 6. Therefore, the electrical receptacle connector 100 provides better results in bending tests and wrenching strength tests. That is, the pins 121 of the rear cover plate 12 can be provided for the electrical receptacle connector 100 to secure with the circuit board 6. Accordingly, when the electrical receptacle connector 100 is connected to an electrical plug connector with the electrical receptacle connector 100 being pulled unintentionally, gaps are not formed between the rear cover plate 12 and the metallic shell 1, and the shielding function of the metallic shell 1 can be provided efficiently for the components inside the metallic shell 1.

Figure 8B:
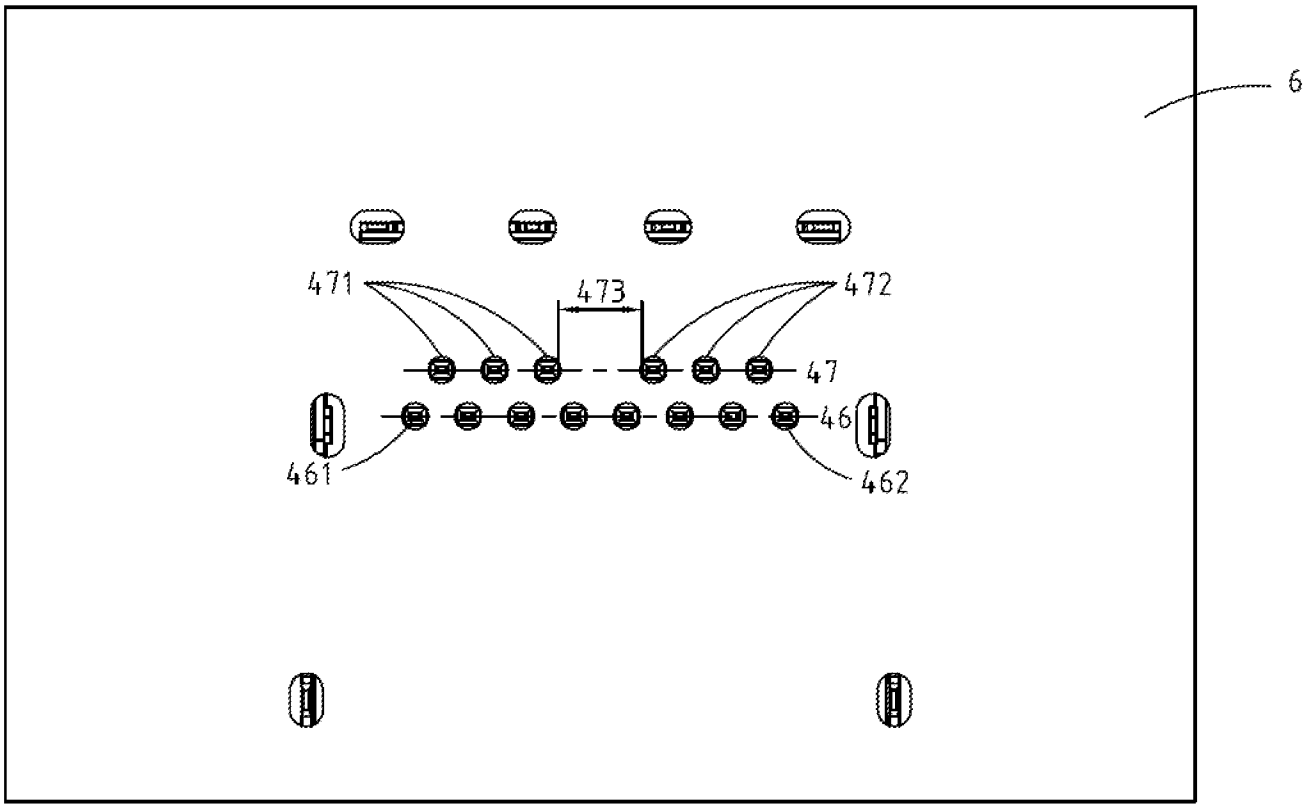
FIG. 8B is a bottom view of the electrical receptacle connector assembled with the circuit board, of the first embodiment, for another implementation aspect.

FIG. 8B is a bottom view of the electrical receptacle connector 100 assembled with the circuit board 6, of the first embodiment, for another implementation aspect. Please refer to FIG. 7 and FIG. 8B, in some implementation aspects, the second row 47 of the tail portions 442 are disposed between the row of the tail portions 352 and the first row 46 of the tail portions 442. That is, the positions of the first row 46 and the second row 47 of the tail portions 442 are exchanged with each other to be the pin assignment shown in FIG. 8B. It is understood that in the aforementioned two configurations, each of the lower-row receptacle terminals 4 transmits a constant signal no matter where the terminal is located at. That is, for example, for a signal terminal in the first row 46, it transmits a signal terminal, while when the pin-assignment configuration is changed and the signal terminal is in the second row 47, it remains transmitting the signal. Consequently, the configuration of the tail portions 442 of the lower-row receptacle terminals 4 can be altered to adapt to circuit boards 6 with different layout configurations.

Figure 9:
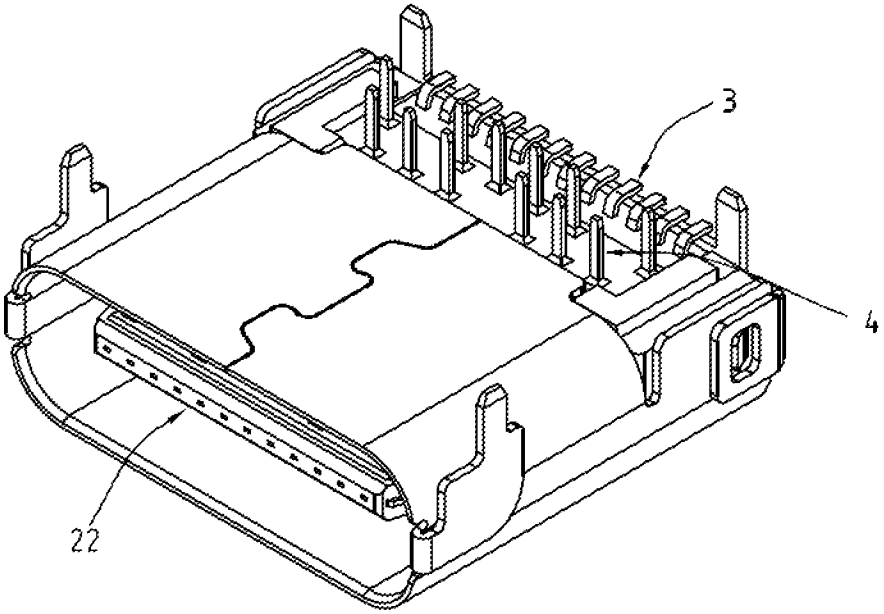
FIG. 9 is a back perspective view of an electrical receptacle connector according to a second embodiment of the instant disclosure.
Figure 10:
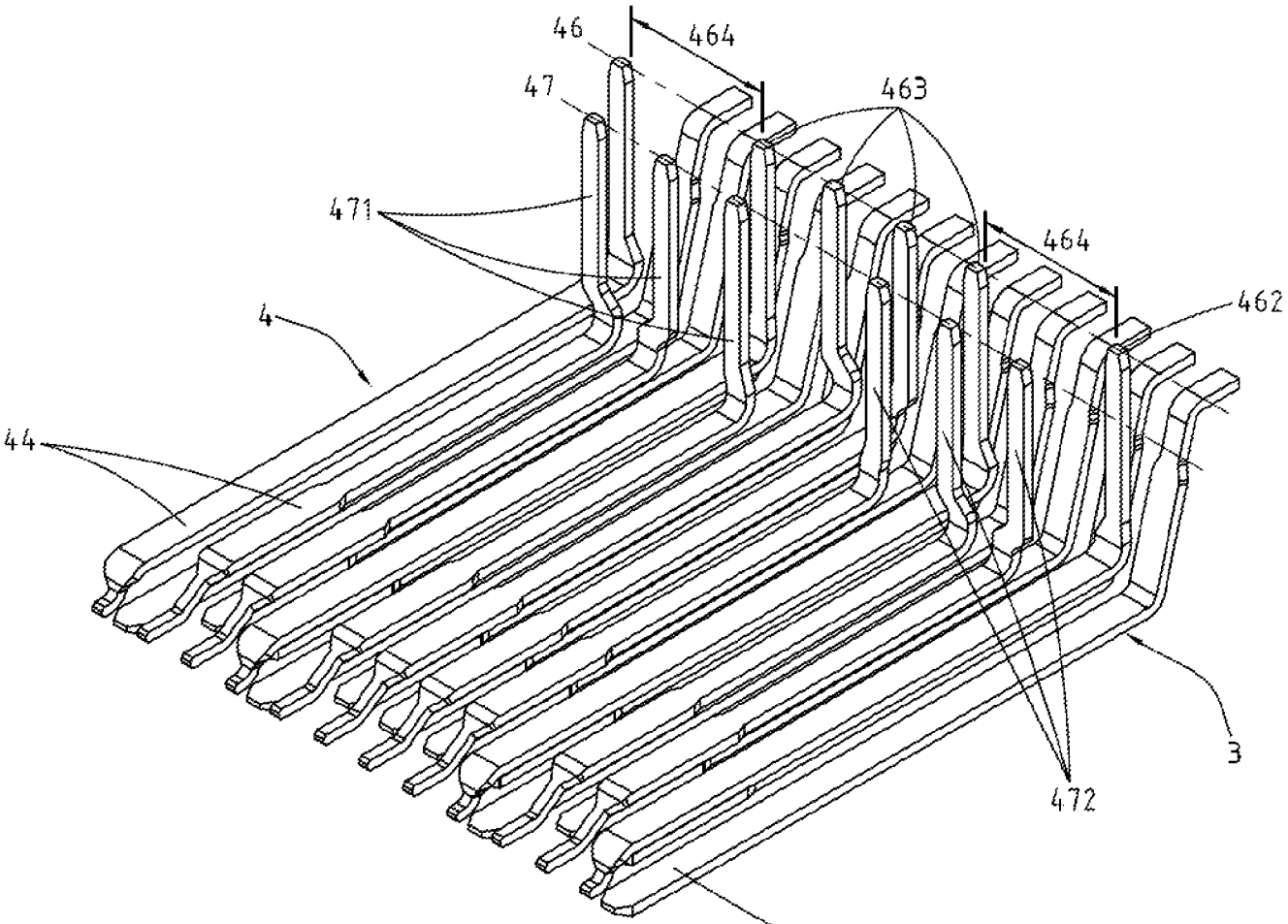
FIG. 10 is a perspective schematic view showing the configuration of the receptacle terminals of the electrical receptacle connector of the second embodiment.
Figure 11A:
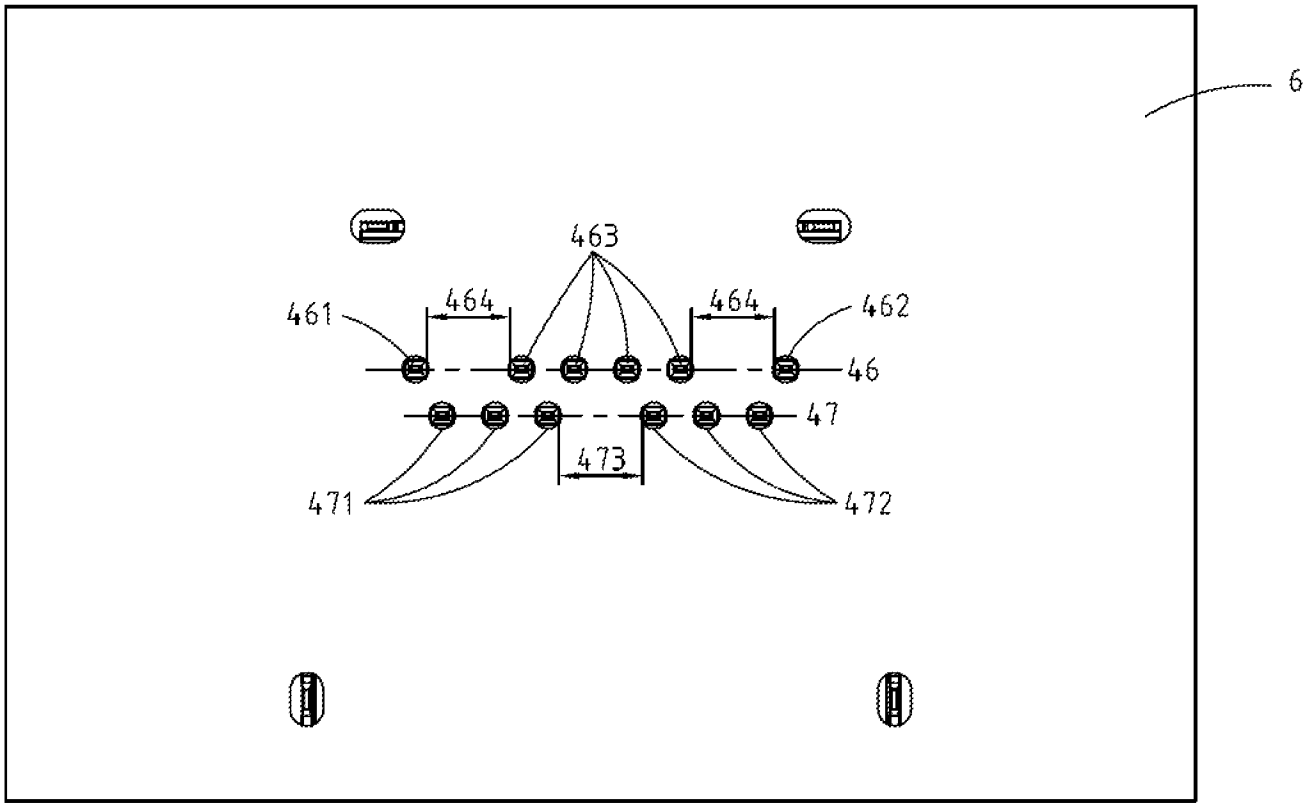
FIG. 11A is a bottom view of the electrical receptacle connector assembled with the circuit board, of the second embodiment, for one implementation aspect.

FIG. 9 is a back perspective view of an electrical receptacle connector 100 according to a second embodiment of the instant disclosure. FIG. 10 is a perspective schematic view showing the configuration of the receptacle terminals 3, 4 of the electrical receptacle connector 100 of the second embodiment. FIG. 11A is a bottom view of the electrical receptacle connector 100 assembled with the circuit board 6, of the second embodiment, for one implementation aspect. Please refer to FIG. 9, FIG. 10, and FIG. 11A, which illustrate an electrical receptacle connector 100 according to a second embodiment of the instant disclosure. The structure of the second embodiment is approximately the same as that of the first embodiment, except that in the second embodiment the grounding sheet 51 of the electrical receptacle connector 100 is omitted. Here, the first row 46 of the tail portions 442 comprise a first pin 461, a second pin 462, a first set of pins 463, and a plurality of first reserved regions 464. The first set of pins 463 is disposed between the first pin 461 and the second pin 462. The first reserved regions 464 are respectively between the first set of pins 463 and the first pin 461 and between the first set of pins 463 and the second pin 462. That is, the contacts 512 of the grounding sheet 51 are omitted, so that the first row 46 of the tail portions 442 comprises the first reserved regions 464. A width of each of the first reserved regions 464 is greater than an interval between two adjacent tail portions 442. Here, the width of the each of the first reserved regions 464 is greater than or equal to two times of the interval between two adjacent tail portions 442. Based on this, when the upper-row receptacle terminals 3 and the lower-row receptacle terminals 4 are provided for transmitting USB 2.0 signals, the grounding sheet 51 and the contacts 512 of the grounding sheet 51 can be omitted to simplify the manufacturing process of the electrical receptacle connector 100.

Here, effective noise grounding and conduction can be accomplished by the pins 121 of the metallic shell 1 connected to the circuit board 6. That is, in some implementation aspects, two pins 121 of the metallic shell 1 are respectively at the two sides the bottom plane 12*a* of the rear cover plate 12 to accomplish effective noise grounding and conduction by the connection of the pins 121 of the metallic shell 1 and the circuit board 6. Furthermore, when the pins 121 of the rear cover plate 12 undergo bending test, a possibility of signal disconnection is reduced.

Additionally, in this embodiment, the second row 47 of the tail portions 442 comprises a second set of pins 471, a third set of pins 472, and a second reserved region 473. The second reserved region 473 is between the second set of pins 471 and the third set of pins 472. That is, the second row 47 of the tail portions 442 comprises the second reserved region 47 without pins. A width of the second reserved region 473 is greater than the interval between each two adjacent tail portions 442. Here, the width of the second reserved region 473 is greater than or equal to two times of the interval between two adjacent tail portions 442.

Figure 11B:
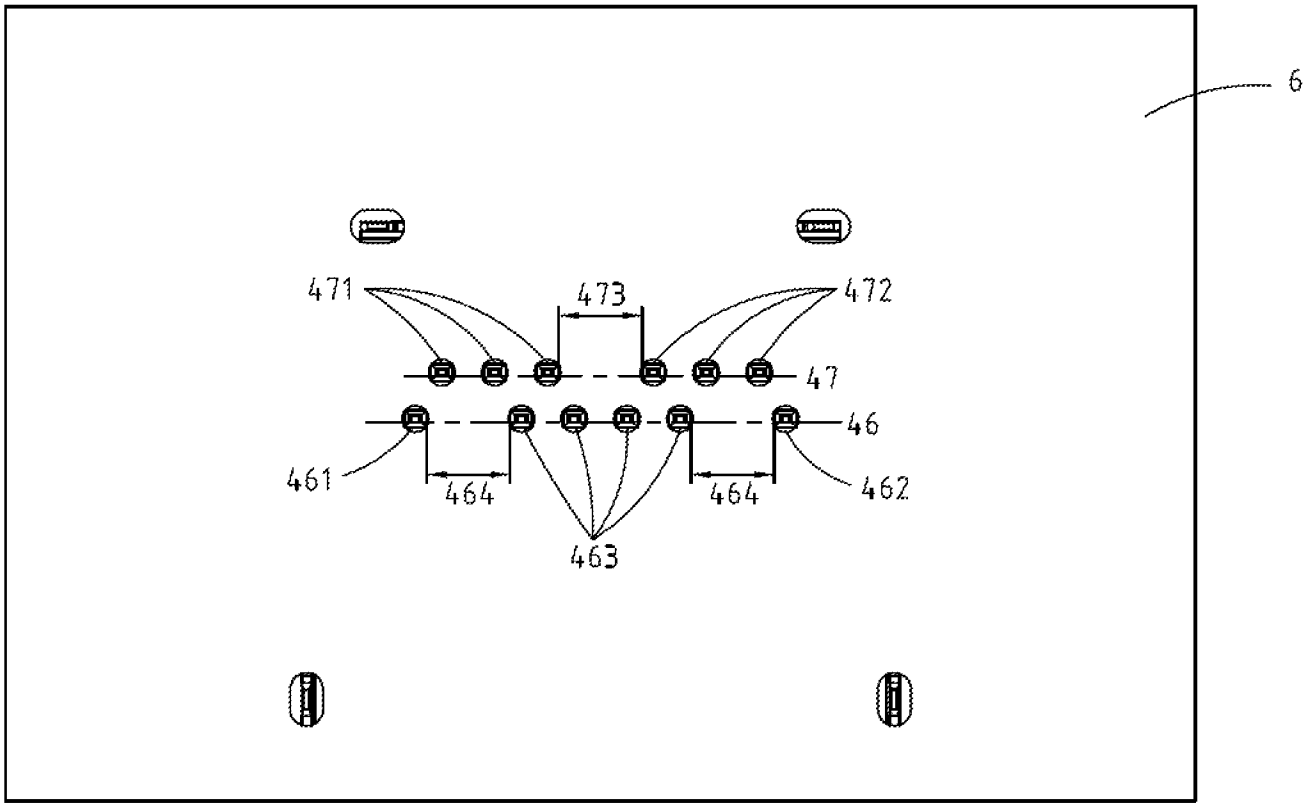
FIG. 11B is a bottom view of the electrical receptacle connector assembled with the circuit board, of the second embodiment, for another implementation aspect.

FIG. 11B is a bottom view of the electrical receptacle connector 100 assembled with the circuit board 6, of the second embodiment, for another implementation aspect. Please refer to FIG. 10 and FIG. 11B, the second row 47 of the tail portions 442 are disposed between the row of the tail portions 352 and the first row 46 of the tail portions 442. That is, the positions of the first row 46 and the second row 47 of the tail portions 442 are exchanged with each other to be the pin assignment shown in FIG. 11B. It is understood that, in the aforementioned two configurations, each of the lower-row receptacle terminals 4 transmits a constant signal no matter where the terminal is located at. Here, the grounding sheet 51 of the electrical receptacle connector 100 can be omitted, and the first row 46 of the tail portions 442 comprises the first pin 461, the second pin 462, the first set of pins 463, and the first reserved regions 464, as described above. The second row 47 of the tail portions 442 comprises the second set of pins 471, the third set of pins 472, and the second reserved region 473, as described above. Based on this, when the upper-row receptacle terminals 3 and lower-row receptacle terminals 4 are provided for transmitting USB 2.0 signals, the grounding sheet 51 and the contacts 512 of the grounding sheet 51 can be omitted to simplify the manufacturing process of the electrical receptacle connector 100.

According to the instant disclosure, when the contacts between the tail portions of the lower-row receptacle terminals (namely, the contacts of the grounding sheet), are omitted, the electrical receptacle connector can transmit USB 2.0 signals without changing or rearranging the configuration of the lower-row receptacle terminals. Therefore, when the electrical receptacle connector is provided for transmitting USB 2.0 signals, manufacturing steps for the grounding sheet and the contacts of the grounding sheet can be omitted so as to simplify the manufacturing process of the electrical receptacle connector and reduce the manufacturing cost of the electrical receptacle connector. Conversely, when the electrical receptacle connector is provided for transmitting USB 3.0 signals, the grounding sheet and the contacts of the grounding sheet are assembled to the electrical receptacle connector, so that effective noise grounding and conduction can be accomplished by the contacts of the grounding sheet connected to the circuit board. Furthermore, the rear cover plate comprises the through-hole legs to be soldered with the circuit board, so that the grounding resistance and the electromagnetic interference can be reduced.

Furthermore, pin-assignments of the upper-row receptacle terminals and the lower-row receptacle terminals are 180 degree symmetrical, dual or double orientation design which enable an electrical plug connector to be inserted into the electrical receptacle connector in either of two intuitive orientations, i.e., in either upside-up or upside-down directions. In other words, the pin-assignments of the upper-row receptacle terminals and the lower-row receptacle terminals have 180 degree symmetrical, dual or double orientation design with respect to a central point of the receptacle cavity as the symmetrical center. Consequently, an electrical plug connector is inserted into the electrical receptacle connector with a first orientation where the upper surface of the tongue portion is facing up, for transmitting first signals. Conversely, the electrical plug connector is inserted into the electrical receptacle connector with a second orientation where the upper surface of the tongue portion is facing down, for transmitting second signals. Furthermore, the specification for transmitting the first signals is conformed to the specification for transmitting the second signals.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell comprising a top cover plate, a rear cover plate, and defining a receptacle cavity, wherein the rear cover plate is extended from a back side of the top cover plate to cover a back side of the receptacle cavity and a plurality of pins are extended from two sides of a bottom of the rear cover plate;

an insulated housing received in the receptacle cavity and comprising a base portion and a tongue portion extended from one of two sides of the base portion, wherein the tongue portion has an upper surface and a lower surface;

a plurality of upper-row receptacle terminals comprising a plurality of signal terminals, at least one power terminal, and at least one ground terminal, wherein each of the upper-row receptacle terminals is held in the base portion and disposed at the upper surface, each of the upper-row receptacle terminals comprises a tail portion protruded from a bottom of the base portion to be arranged into a row, and the tail portions of the upper-row receptacle terminals are near to the pins; and a plurality of lower-row receptacle terminals comprising a plurality of signal terminals, at least one power terminal, and at least one ground terminal, wherein each of the lower-row receptacle terminals is held in the base portion and disposed at the lower surface, each of the lower-row receptacle terminals comprises a tail portion protruded from the bottom of the base portion to be arranged into a first row and a second row, wherein the tail portions of the lower-row receptacle terminals are parallel to the tail portions of the upper-row receptacle terminals.

2. The electrical receptacle connector according to claim 1, wherein the first row of the tail portions of the lower-row receptacle terminals are disposed between the row of the tail portions of the upper-row receptacle terminals and the second row of the tail portions of the lower-row receptacle terminals.

3. The electrical receptacle connector according to claim 1, wherein the second row of the tail portions of the lower-row receptacle terminals are disposed between the row of the tail portions of the upper-row receptacle terminals and the first row of the tail portions of the lower-row receptacle terminals.

4. The electrical receptacle connector according to claim 2, wherein the first row of the tail portions of the lower-row receptacle terminals comprises a first pin, a second pin, a first set of pins and, a plurality of first reserved regions, the first set of pins are disposed between the first pin and the second pin, the first reserved regions are respectively between the first set of pins and the first pin and between the first set of pins and the second pin.

5. The electrical receptacle connector according to claim 3, wherein the first row of the tail portions of the lower-row receptacle terminals comprises a first pin, a second pin, a first set of pins, and a plurality of first reserved regions, wherein the first set of pins are disposed between the first pin and the second pin and the first reserved regions are respectively between the first set of pins and the first pin and between the first set of pins and the second pin.

6. The electrical receptacle connector according to claim 4, wherein a width of each of the first reserved regions is greater than an interval between the tail portions of adjacent two lower-row receptacle terminals.

7. The electrical receptacle connector according to claim 5, wherein a width of each of the first reserved regions is greater than an interval between the tail portions of adjacent two lower-row receptacle terminals.

8. The electrical receptacle connector according to claim 2, wherein the second row of the tail portions of the lower-row receptacle terminals comprises a second set of pins, a third set of pins, and a second reserved region, wherein the second reserved region is between the second set of pins and the third set of pins.

9. The electrical receptacle connector according to claim 3, wherein the second row of the tail portions of the lower-row receptacle terminals comprises a second set of pins, a third set of pins, and a second reserved region, wherein the second reserved region is between the second set of pins and the third set of pins.

10. The electrical receptacle connector according to claim 8, wherein a width of the second reserved region is greater than an interval between the tail portions of adjacent two lower-row receptacle terminals.

11. The electrical receptacle connector according to claim 9, wherein a width of the second reserved region is greater than an interval between the tail portions of adjacent two lower-row receptacle terminals.

12. The electrical receptacle connector according to claim 1, wherein the rear cover plate comprises a bottom plane, wherein the pins are extended from two sides of the bottom plane, respectively.

13. The electrical receptacle connector according to claim 1, wherein the insulated housing further comprises a grounding sheet at the base portion and the tongue portion, the grounding sheet comprises a main body and a plurality of contacts, the main body is between the upper-row receptacle terminals and the lower-row receptacle terminals, the contacts are extended from the main body and protruded from the bottom of the base portion and arranged between the tail portions of the lower-row receptacle terminals.

14. The electrical receptacle connector according to claim 1, wherein the lower-row receptacle terminals comprise a plurality ground terminals, a first pair of differential signal terminals, a second pair of differential signal terminals, a third pair of differential signal terminals, and a plurality of power terminals, the first pair of differential signal terminals, wherein the second pair of differential signal terminals, and the third pair of differential signal terminals are disposed between the ground terminals, and the power terminals are disposed between the first pair of differential signal terminals, the second pair of differential signal terminals, and the third pair of differential signal terminals.

15. The electrical receptacle connector according to claim 1, wherein each of the upper-row receptacle terminals comprises:

a body portion held in the insulated housing; and a flat contact portion, extended from one of two ends of the body portion and disposed at the upper surface;

wherein, each of the tail portions is extended from the other end of the corresponding body portion and exposed out of the insulated housing.

16. The electrical receptacle connector according to claim 1, wherein each of the lower-row receptacle terminals comprises:

a body portion held in the insulated housing; and a flat contact portion, extended from one of two ends of the body portion and disposed at the lower surface;

wherein, each of the tail portions is extended from the other end of the corresponding body portion and exposed out of the insulated housing.

17. The electrical receptacle connector according to claim 1, wherein the upper-row receptacle terminals and the lower-row receptacle terminals have 180 degree symmetrical design with respect to a central point of the receptacle cavity as the symmetrical center.

* * * * *